United States Patent [19]

Kasai et al.

[11] 4,396,185

[45] Aug. 2, 1983

[54] CLAMPING APPARATUS FOR MACHINE TOOLS

[75] Inventors: Shigeo Kasai, Sagamihara; Tsuneo Aizawa, Isehara; Kiju Kawada, Atsugi, all of Japan

[73] Assignee: Amada Company, Limited, Japan

[21] Appl. No.: 217,048

[22] Filed: Dec. 16, 1980

[30] Foreign Application Priority Data

Dec. 18, 1979 [JP] Japan ..... 54-163590

[51] Int. Cl.[3] ..... B25B 1/00

[52] U.S. Cl. ..... 269/157; 269/224; 269/238; 83/458; 83/459

[58] Field of Search ..... 83/277, 151, 153, 458, 83/459; 269/238, 224, 56, 254 R, 254 CS, 157, 160, 161

[56] References Cited

U.S. PATENT DOCUMENTS

| | | | |
|---|---|---|---|
| 457,997 | 8/1891 | Lorey | 269/161 |
| 647,520 | 4/1900 | Prindle | 269/157 |
| 3,595,112 | 7/1971 | De George et al. . | |
| 3,835,743 | 9/1974 | Taylor et al. . | |
| 4,052,047 | 10/1977 | Bailey | 269/238 |
| 4,234,174 | 11/1980 | Cardono | 269/157 |

*Primary Examiner*—Robert C. Watson

*Attorney, Agent, or Firm*—Wigman & Cohen

[57] ABSTRACT

A clamping apparatus (3) for holding a workpiece (W) between an upper punching tool (19) and a lower punching tool (21) in a machine (1). A frame (33) attaches the clamping apparatus (3) to the machine (1). The clamping apparatus (3) comprises an upper clamp (61) and a lower clamp (57), the latter pivotably cooperating with the upper clamp (61) in order to secure the workpiece (W). The clamping apparatus (3) also comprises a plate member (51) and rods (49) and (75). These rods (49) and (75) are mounted in the frame (33) in a direction perpendicular to the workpiece (W). The lower end of the rods (49) and (75) are attached to the lower clamp (57) and the upper end of the rods (49) and (75) are attached to the plate member (51). A spring (83) is arranged between the lower clamp (57) and the plate member (51) for the purpose of maintaining the lower clamp (57) and the plate member (51) in horizontal orientation whenever the lower clamp (57) collides with the lower punching tool (21).

3 Claims, 7 Drawing Figures

CLAMPING APPARATUS FOR MACHINE TOOLS

BACKGROUND OF THE INVENTION

1. Field of the Invention

The present invention relates generally to machine tools such as punch presses and laser processing machines and more particularly to clamping apparatus for clamping materials to be processed such as sheet materials in machine tools such as punch presses, laser working machines and drilling machines.

2. Description of the Prior Art

The prior art concerning the present invention will be described, by way of example, by reference to what is called a turret punch press. A turret punch press has turrets for holding punching tools to make holes in sheet materials such as metal sheets. The present invention is applicable not only to other punch presses in addition to turret punch presses, but also to other machine tools such as laser processing machines.

As is well known, the turret punch press comprises a vertically movable ram and a pair of rotatable upper and lower turrets for holding a plurality of upper and lower punching tools which are varied in size and shape to punch a variety of holes in sheet materials such as metal sheets. The upper and lower turrets are substantially vertically spaced from each other beneath the ram and are horizontally disposed on their respective shafts, which shafts are vertically disposed so as to coaxially align with each other. Each of the upper punching tools on the uppr turret is so located as to vertically align with either of the lower punching tools on the lower turret to cooperate with each other to punch holes of a peculiar shape. Also, the upper and lower turrets are so arranged so to be simultaneously rotated by power to bring a desired pair of the upper and lower tols into a portion just beneath the ram so as to enable them to be worked by the ram to punch holes of a desired shape. In this arrangement, a workpiece such as a metal sheet is horizontally fed by a plurality (usually a pair) of clamping means into a space between the upper and lower turrets; namely the upper and lower punching tools which have been placed just beneath the ram by the upper and lower turrets. The clamping means are so arranged as to grip an end of the workpiece and to move the workpiece in any direction toward and away from the upper and lower turrets in order to bring any portion of the workpiece into a position beneath the ram. Also, in order to automatically and continuously punch a number of holes varying in size and shape in the workpiece, the upper and lower turrets and the clamping means are so arranged as to be rotated and moved under a preprogrammed numerical control.

In the conventional turret punch press of the above described arrangement, it has been disadvantageous that the clamping means for clamping the workpiece will often inevitably go into collision with any of the lower punching tools on the lower turret. The clamping means will collide with any of the lower punching tools when it is moving in the proximity of the upper and lower turrets to place just beneath the ram a portion of the workpiece close to the clamped end thereof. Since the clamping means is moved by power at high speed, the clamping means and the lower punching tools will suffer from great shock which will shorten their useful lives and decrease the punching accuracy, when they collide with each other. Accordingly, it has been necessary to decrease the shock which is caused by the collision of the clamping means and lower punching tools, especially in order to move the clamping means at high speed to perform punching operations at higher speed.

As another conventional disadvantage with regard to the turret punch press, workpieces such as metal sheets are often originally bent or warped and also will become bent or warped upwardly away from the horizontal level when continuously punched. Accordingly, there has been a need that the clamping means cope with the bends or warps of workpieces being punched in order to perform accurate punching operations without damaging the workpieces.

SUMMARY OF THE INVENTION

It is an object of the present invention to provide a device which can resiliently move to feed and position a workpiece to be processed in machine tools such as punching presses, laser working machines and drilling machines.

It is a further object of the present invention to provide a clamping apparatus which can resiliently move against or cope with an obstacle with little shock to feed and position a workpiece to be processed in machine tools.

It is another object of the present invention to provide a clamping apparatus which can resiliently cope with the state of a workpiece to be processed to feed and position the same in machine tools.

It is therefore another object of the present invention to provide a clamping apparatus for machine tools which can stand long use.

It is a still further object of the present invention to provide a clamping apparatus for machine tools which will enable workpieces to be processed with a high degree of accuracy.

It is a still further object of the present invention to provide a clamping apparatus for machine tools which is simple in construction and therefore can be manufactured at a low cost.

According to the present invention, these objects are accomplished by so arranging clamping members for clamping the workpiece as to resiliently swing and resiliently vertically move in the clamping apparatus when feeding and positioning the workpiece in machine tools.

Other and further objects and advantages of the present invention will be apparent from the following description and accompanying drawings which, by way of illustration, show a preferred embodiment of the present invention and the principle thereof.

DESCRIPTION OF THE PREFERRED EMBODIMENTS

Figure 1:
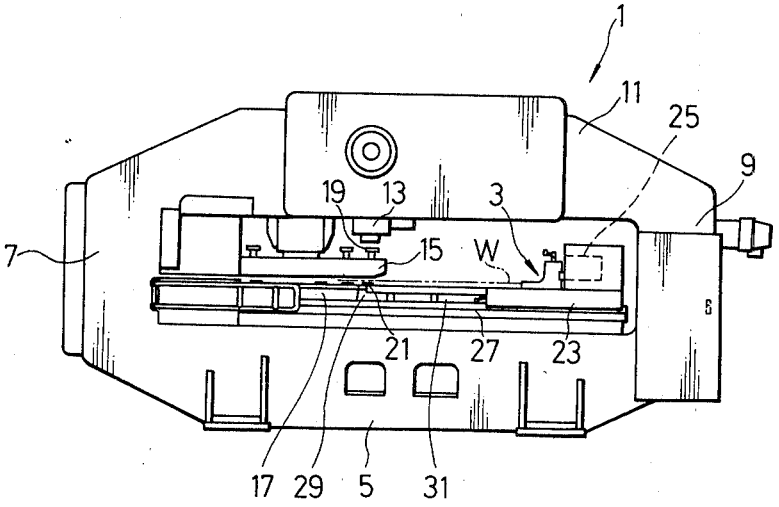
FIG. 1 is a front elevational view of a turret punch press which is provided with an apparatus embodying the principles of the present invention.

Referring to FIG. 1, the turret punch press generally designated by the numeral 1 is shown as having been equipped with the clamping apparatus 3 clamping a workpiece W to be punched according to the present invention. In this connection, however, it is to be initially noted that the clamping apparatus embodying the principles of the present invention can be incorporated into other punch presses in addition to turret punch presses and other machine tools such as laser working machines and drilling machines.

The turret punch press 1 is constructed of a base 5, a pair of side frames 7 and 9 vertically fixed to the ends of the base 5. Also, the turret punch press 1 comprises a ram 13 and an upper turret 15 and a lower turret 7 holding a plurality of upper punching tools 19 and lower punching tools 21 which are varied in size and shape. The ram 13 is vertically movably mounted at the substantially midway portion of the overhead frame 11. Ram 13 is vertically driven by power to act on the upper and lower punching tools 19 and 21 placed therebeneath. The upper turret 15 is so mounted as to rotatably hang from the overhead frame 11 with its shaft vertical to rotate partially beneath the ram 13, while the lower turret 17 is rotatably mounted on the base 5 just beneath the upper turret 15 in a coaxial relation therewith. Also, the upper and lower turrets 15 and 17 are so arranged that pairs of the upper and lower punching tools 19 and 21 common in size and shape vertically align with each other. In this arrangement they are simultaneously driven by power to bring a desired pair of the upper and lower punching tools 19 and 21 into alignment beneath the ram 13.

In order to feed and position the workpiece W to be punched, the turret punch press 1 is provided with a first carriage 23 which is movable toward and away from the upper and lower turrets 15 and 17 and a second carriage 25 which is slidably mounted on the first carriage 23 and holds the clamping apparatus 3 clamping the workpiece W. The first carriage 23 is slidably mounted on rails 27 which are fixed on the upper portion of the base 5 so that the first carriage 23 may be horizontally moved toward and away from the upper and lower turrets 15 and 17 when driven by power. The second carriage 25, holding the clamping apparatus 3, is mounted on the first carriage 23 so that it may be horizontally moved by power in any direction at right angles with the rails 27. Also, a fixed table 29 is provided on the base 5 so that the workpiece W can be slid thereon. Furthermore a pair of movable tables 31 may be fixed to the first carriage 23 to hold the extending ends of the workpiece W.

In the above described arrangement, the workpiece W, which is gripped by the clamping apparatus 3, can be fed into a space between the upper and lower turrets 15 and 17 and positioned just beneath the ram 13 by moving the first and second carriages 23 and 25. Before or as soon as the workpiece W is positioned between the upper and lower turrets 15 and 17 just beneath the ram 13, a desired pair of upper and lower punching tools 19 and 21 are placed just beneath the ram 13 by the upper and lower turrets 15 and 17, and thus the workpiece W is punched by the upper and lower punching tools 19 and 21 when the ram 13 is lowered to press the upper punching tool 19. Also, a number of holes varied in size and shape are automatically and continuously punched in the workpiece W by moving the upper and lower turrets 15 and 17 and the first and second carriages 23 and 25 under a numerical control which is preprogrammed.

Figure 2:
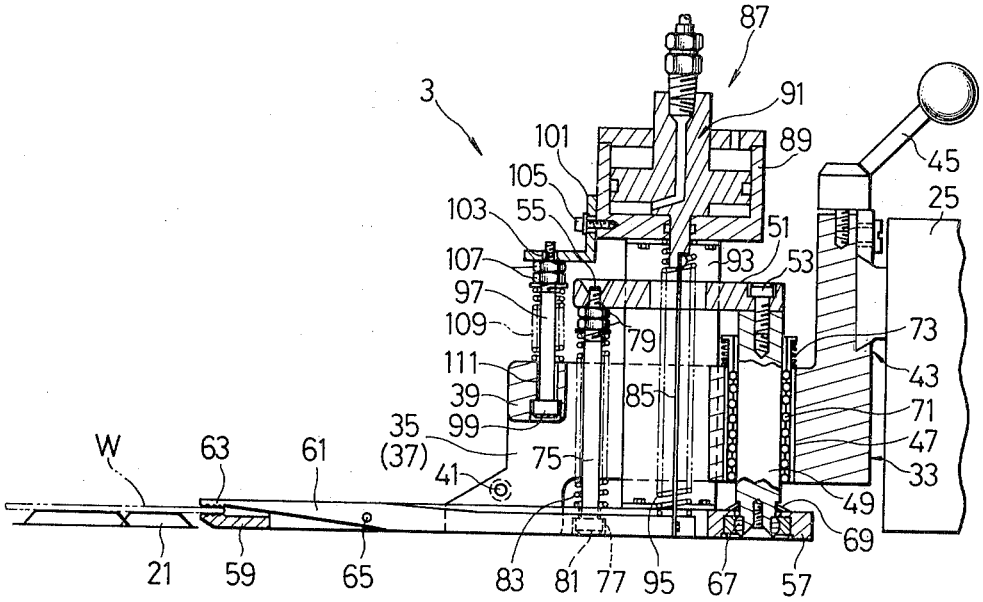
FIG. 2 is a sectional view of the apparatus embodying the principles of the present invention which shows the apparatus as mounted on the turret punch press shown in FIG. 1 together with portions thereof and is taken along the line II—II of FIG. 3.
Figure 3:
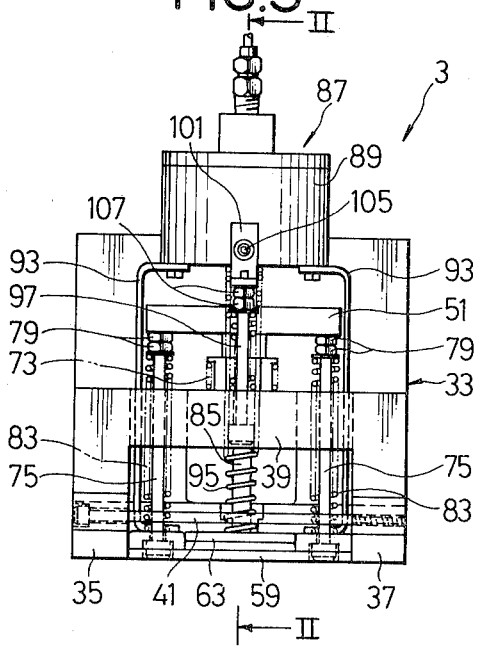
FIG. 3 is an elevational view of the apparatus shown in FIG. 2.

Referring now to FIGS. 2 and 3, the clamping apparatus 3 according to the present invention is constructed of a frame 33 having a pair of arms 35 and 37 which are disposed to horizontally extend parallel with each other and are connected at their ends with each other by a beam member 39 and a tie rod member 41. The frame 33 is detachably and adjustably fixed to the second carriage 25 so that the position of the clamping apparatus 3 may be horizontally adjusted its entirety in with regard to the second carriage 25. In the preferred embodiment, the frame 33 is slidably connected at its back side opposite to the arms 35 and 37 to the second carriage 25 by a dovetail arrangement 43 and is so designed as to be detachably and adjustably fixed to the second carriage member 25 by a lever 45. In this connection, the clamping apparatuses 3, which are more than two in number, are adjustably fixed to the second carriage 25 for that their distance from each other can be adjusted according to the width of the workpiece W to be clamped and punched.

The frame 33 of the clamping apparatus 3 is formed with a vertical bore 47 and has a rod member 49 slidably put in the bore 47 in such a manner as to project out therefrom at the upper and lower ends. The rod member 49 is provided at its top end with a plate member 51 which is fixed thereto by a bolt 53 at a right angle thereto in order to extend in the same direction as the arms 35 and 37. Plate member 51 is provided with a plurality of holes 55 preferably conical in shape for the purpose to be described in detail hereinafter. The rod member 49 is provided at its lower end with a lower clamping member 57 having a clamping jaw 59 which is coupled to an upper clamping member 61 having a clamping jaw 63 by a pin 65 to clamp the workpiece W to be punched. The lower clamping member 57 is disposed to extend toward the upper and lower turrets 15 and 17 together with the upper clamping member 61 and it is pivotally or rockably connected to the lower end of the rod member 49 by a spherical bearing 67.

In the preferred embodiment, there is provided a disk spring 69 to eliminate backlashes among the spherical bearing 67, the lower clamping member 57 and the rod member 49. Also, in the preferred embodiment, the rod member 49 is put in the bore 47 and is surrounded by means of a bearing bushing 71 which is retained in bore 47 by a spiral spring 73 for the purpose of freely sliding therein.

There are provided between the arms 35 and 37 a plurality of rods 75 which are loosely inserted at their upper ends in the holes 55 of the plate member 51 and are slidably extended at their lower ends through bores 77 formed through the lower clamping member 57. Each of the rods 75 is substantially equal in length to the rod member 49 and is provided at their upper and lower ends with a plurality of nuts 79 and a flange 81, respectively. Rods 75 are also upwardly biased against the plate member 51 by a helical spring 83.

In the above described arrangement, when the lower clamping member 57 is upwardly swung around the spherical bearing 67, the plate member 51 is raised by the lower clamping member 57 by means of the spring 83 and therefore the rod member 49 is also raised by the plate member 51 to raise the lower clamping member 57. Thus, it will be understood that the lower clamping member 57 is resiliently swung around the spherical bearing 67 and then the lower clamping member 57 will be instantaneously raised together with the upper clamping member 61 in order to remain horizontal at the raised position.

In order to clamp the workpiece W to be punched, the upper clamping member 61 is connected by an elongated pulling member 85 to a motor 87 which may be of a cylinder type hydraulically or pneumatically operated. In the preferred embodiment, the motor 87 is constructed of a cylinder 89 including a piston and rod 91 to which the pulling member 85 is connected. Motor 87 is supported by a pair of brackets 93 which are fixedly mounted on the lower clamping member 57. Thus, when the pulling member 85 is pulled upwardly by the piston and rod 91, the upper clamping member 61 is swung by the pulling member 85 around the pin 65 in cooperation with the lower clamping member 57 in order to enable the clamping jaws 59 and 63 to clamp the workpiece W. Also, in order to unclamp the workpiece W, a helical spring 95 is biased between the upper clamping member 61 and the cylinder 89 of the motor 87 in order to bias the upper clamping member 61 around the pin 65 away from the lower clamping member 57.

In order to vertically adjust the height of the upper and lower clamping members 61 and 57, there is provided an adjusting member 97 having a flange 99 at its lower end between the beam member 39 of the frame 33 and a bracket 101 which has a bore 103. Bracket 101 is adjustably fixed by a bolt 105 to the cylinder 89 of the motor 87. The adjusting member 97 is provided with a plurality of nuts 107 and a helical spring 109. Adjusting member 97 also is vertically slidably inserted in a bore 111 vertically formed through the beam member 39 of the frame 33. Adjusting member 97 is slidably inserted at its top end in the bore 103 of the bracket 101. In this arrangement, the height of the upper and lower clamping members 61 and 57 can be adjusted by adjusting either the nuts 107 or the bracket 101. In this connection, it will be understood that the spring 109 will act to support the motor 87, the brackets 93 and the upper and lower clamping members 61 and 57 to decrease their total weight, although another kind of spring can be provided instead of the helical spring 109 for this purpose.

As is now understood from the above description, when the lower clamping member 57 goes into collision with any of the lower punching tools 21 together with the upper clamping member 61, it will be resiliently swung at first and then will be raised instantaneously together with the upper clamping member 61 to become horizontal. Also, when the clamping jaws 59 and 63 of the clamping members 57 and 61 are clamping the workpiece W which has been bent or warped, the lower clamping member 57 will raise the rod member 49 and will be resiliently swung together with the upper clamping member 61 substantially around the end of the workpiece W clamped by the clamping jaws 59 and 63 to cope with the bend or warp of the workpiece W.

Figure 4:
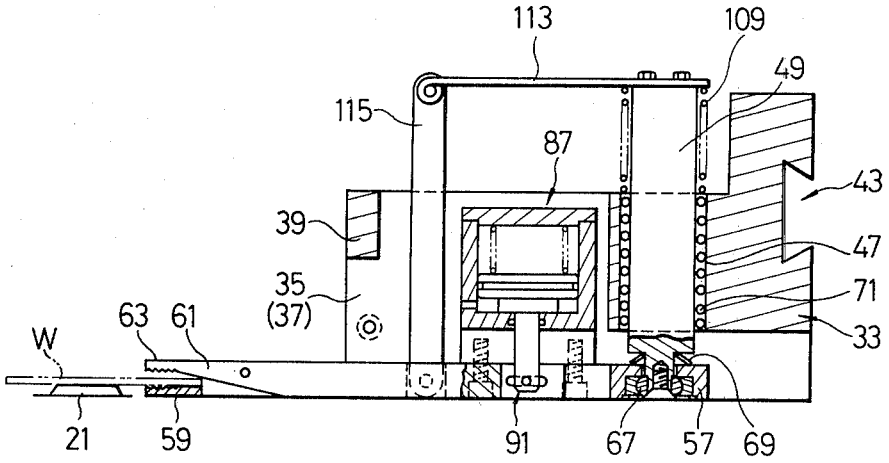
FIG. 4 is a sectional view showing a modified embodiment of the apparatus according to the present invention more or less in the same manner as FIG. 2 and in section taken along the line IV—IV of FIG. 5.
Figure 5:
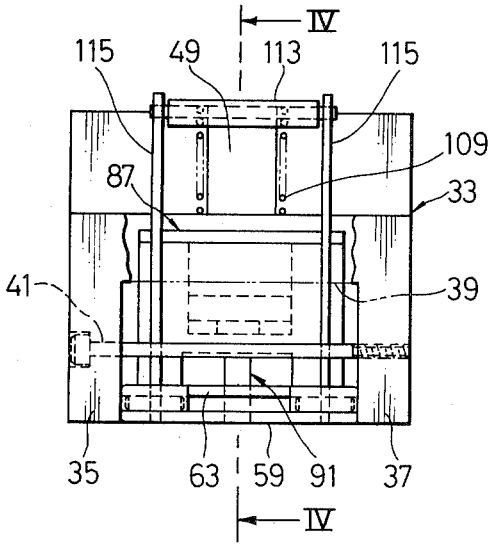
FIG. 5 is an elevational view of the apparatus shown in FIG. 4.

Referring to FIGS. 4 and 5, there is shown a second embodiment in which a leaf spring 113 is used in place of the plate member 51 and the spring 83 in the first embodiment shown in FIGS. 2 and 3 together with leaf spring 113, link members 115 are mounted on lower clamping member 57 instead of the rod member 75 of the first embodiment. Also, the piston and rod 91 is directly connected to the upper clamping member 61.

Figure 6:
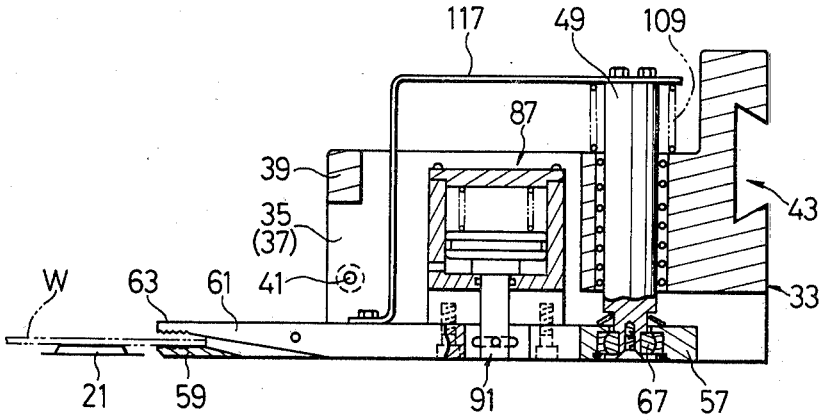
FIG. 6 is a sectional view showing another modified embodiment of the apparatus according to the present invention more or less in the same manner as FIGS. 2 and 4 and in section taken along the line VI—VI of FIG. 7.
Figure 7:
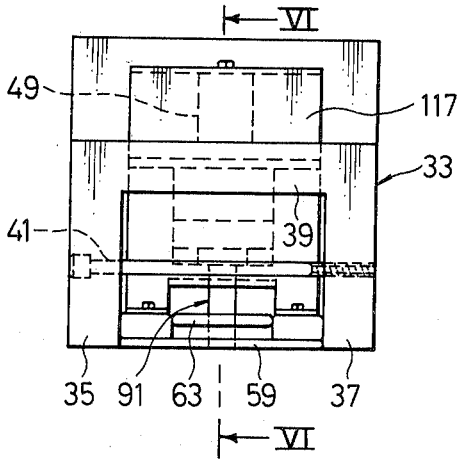
FIG. 7 is an elevational view of the apparatus shown in FIG. 6.

Referring to FIGS. 6 and 7, there is shown a third embodiment which is similar to the second embodiment shown in FIGS. 4 and 5 but is different therefrom in that a leaf spring 117 of a bent shape is used in place of the leaf spring 113 and the link members 115 of the second embodiment.

Although a preferred form of the present invention has been illustrated and described, it should be understood that the device is capable of modification by one skilled in the art without departing from the principles of the invention. Accordingly, the scope of the invention is to be limited only by the claims appended hereto.

We claim:

1. Clamping apparatus for holding a workpiece between upper and lower punching tools in a machine, comprising:

frame means for attaching said clamping apparatus to said machine;

upper clamping means;

lower clamping means for pivotally cooperating with said upper clamping means for securing said workpiece;

a plate member;

rod means, mounted in said frame means in a direction perpendicular to said workpiece, the lower end of said rod means being attached to said lower clamping means and the upper end of said rod means being attached to said plate member; and spring means, arranged between said lower clamping means and said plate member, for maintaining said lower clamping means and said plate member in horizontal orientation whenever said lower clamping means collides with said lower punching tool.

2. The apparatus of claim 1, further including motor means for moving said upper and lower clamping means into closed and open positions.

3. The apparatus of claim 1, wherein said plate member is arranged substantially parallel to said workpiece.

* * * * *